US005927689A

United States Patent [19]

Johnson

[11] Patent Number: 5,927,689

[45] Date of Patent: Jul. 27, 1999

[54] HAND OPERABLE MOTORCYCLE STAND

[76] Inventor: Robert C. Johnson, 7741-237th Ave. NE., Stacy, Minn. 55079

[21] Appl. No.: 08/992,237

[22] Filed: Dec. 17, 1997

[51] Int. Cl.[6] ..... B66F 7/22

[52] U.S. Cl. ..... 254/131

[58] Field of Search ..... 254/10 R, 10 B, 254/10 C, 131, 120, 134, 133

[56] References Cited

U.S. PATENT DOCUMENTS

| | | | |
|---|---|---|---|
| 1,171,049 | 2/1916 | Jeffery . | |
| 1,307,600 | 6/1919 | Rose et al. . | |
| 1,354,529 | 10/1920 | Alexander . | |
| 1,492,461 | 4/1924 | Howe . | |
| 3,059,904 | 10/1962 | Kimball | 254/10 C |
| 4,113,235 | 9/1978 | Hartman, Jr. . | |
| 4,180,253 | 12/1979 | Ivers et al. . | |
| 4,193,582 | 3/1980 | Neilsen . | |
| 4,324,384 | 4/1982 | Elser . | |
| 4,348,010 | 9/1982 | Baxter . | |
| 5,518,224 | 5/1996 | Anderson | 254/131 |
| 5,639,067 | 6/1997 | Johnson . | |
| 5,769,396 | 6/1998 | Tischendorf | 254/10 C |

*Primary Examiner*—Robert C. Watson
*Attorney, Agent, or Firm*—Michael Sherrill

[57] ABSTRACT

A compact, hand-operable stand for quickly and easily elevating a motorcycle, including (i) a base assembly, and (ii) a support assembly pivotably attached to the base assembly for pivoting about a longitudinal axis between a clearance position and a support position, and including a pair of transversely spaced support arms and a means for effecting simultaneous pivoting of both support arms between the clearance and support positions.

12 Claims, 12 Drawing Sheets

HAND OPERABLE MOTORCYCLE STAND

FIELD OF THE INVENTION

The present invention relates generally to jacks, and more particularly to portable jacks or supports for elevating at least one of the two ends of a motorized two-wheel vehicle such as a motorcycle.

BACKGROUND

The need has existed ever since motorized two-wheel vehicles were first developed for a convenient way to service the wheel and related components at one end of the vehicle. Although ramps or lifts may be helpful, they generally take up a large amount of space. Furthermore, the motorcycle may require emergency servicing at a location remote from the bulky ramps and lifts, as when a mechanical failure occurs while the motorcycle is on the road.

Attempts have also been made to rely on the motorcycle kickstand to support the cycle while servicing it. However, the kickstand, although attached directly to the frame of the cycle itself and therefore extremely portable, has a relatively pointed end that may dig into sand, grass or blacktop resulting in unstable support for the motorcycle. Additionally, using the kickstand will not lift the front or rear wheel of the cycle off the ground.

Devices are also known for elevating automobiles by engaging an axle of the vehicle. However, motorcycles lack a suitably exposed axle, and the adaptation of such devices to motorcycles have resulted in the risk of scratching or damaging the surface of the motorcycle frame with the lift.

A compact motorcycle stand is disclosed in U.S. Pat. No. 5,639,067 issued to Robert C. Johnson. The motorcycle stand includes a support roller (12) pivotably mounted to a base assembly (18) by means of an axle (56 and 58), with the axle fixedly attached to the support roller by a pair of brackets (14 and 16) and rotatably extending through a pair of bearings (50 and 52) secured to the base assembly. One end of the axle extends a distance beyond the base assembly for permitting rotation of the axle between a clearance position (forward of the base assembly) and a support position (above the base assembly) with a wrench (86) and appropriately sized socket (88).

While the motorcycle stand disclosed in U.S. Pat. No. 5,639,067 represents a significant advance, a continuing demand exists for still further improved motorcycle stands.

SUMMARY OF THE INVENTION

The invention is a compact, hand-operable stand for quickly and easily elevating a motorcycle. The basic stand includes(i) a base, and (ii) a support assembly pivotably attached to the base for pivoting about a longitudinal axis between a clearance position and a support position, and (iii) a means for preventing continued pivoting of the support assembly beyond the support position. The support assembly includes a pair of transversely spaced support arms, and a means for effecting simultaneous pivoting of both support arms between the clearance position and the support position.

When pivoted into the clearance position, the support assembly is pivoted downward into the plane defined by the base for permitting the stand to be slid underneath the frame of a motorcycle. When pivoted into the support position, the support assembly is pivoted upward from the plane defined by the base for permitting the support assembly to contact the frame of a motorcycle and elevate the motorcycle above grade.

The stand can further include a mounting assembly pivotably attached to the base and holding the support assembly in a transversely spaced relationship relative to the base, with the support assembly and mounting assembly pivotable together between the clearance position and the support position.

The stand can include one or more additional features selected from, (a) providing a means for repositionably attaching the support assembly to the mounting assembly at a plurality of different distances between the support assembly and the base assembly and thereby changing the height to which the stand is capable of elevating a motorcycle, and (b) providing a flange extending from a first longitudinal end of the base assembly effective for being engaged by a user's foot so as to stabilize the stand during pivoting of the support assembly between the clearance and support positions.

DETAILED DESCRIPTION OF THE INVENTION INCLUDING A BEST MODE

| Nomenclature | |
|---|---|
| F | Frame of Motorcycle |
| M | Motorcycle |

-continued

| Nomenclature | |
|---|---|
| 100 | Stand |
| 110 | Base Assembly |
| 111 | Central Beam |
| 111c | Top Flange of Beam |
| 111d | Bottom Flange of Beam |
| 112 | First Leg |
| 113 | Foot Flange |
| 114 | Second Leg |
| 115 | Main Bearings |
| 120 | Support Assembly |
| 121 | Axle of Support Assembly |
| 121a | First End of Axle |
| 121b | Second End of Axle |
| 121g | Circumferential Grooves in Axle |
| 122 | Support Tube |
| 123 | Outer Layer of Material |
| 125 | Bearings for Axle of Support Assembly |
| 126 | Connect Arms |
| 127 | Holes Through Ends of Connect Arms |
| 130 | Mounting Assembly |
| 131 | Pivot Shaft |
| 131a | First End of Pivot Shaft |
| 131b | Second End of Pivot Shaft |
| 131g | Circumferential Grooves in Pivot Shaft |
| 132 | Brackets |
| 132a | Proximal End of Bracket |
| 132b | Distal End of Bracket |
| 133 | Finger |
| 134 | Holes Through Bracket for Axle of Support Assembly |
| 135 | Hole Through Bracket for Pivot Shaft |
| 136 | Outer Layer of Material |
| 200 | Tool |
| 201 | Handle |
| 202 | Socket |
| 203 | Dowel |

Construction

Figure 1:
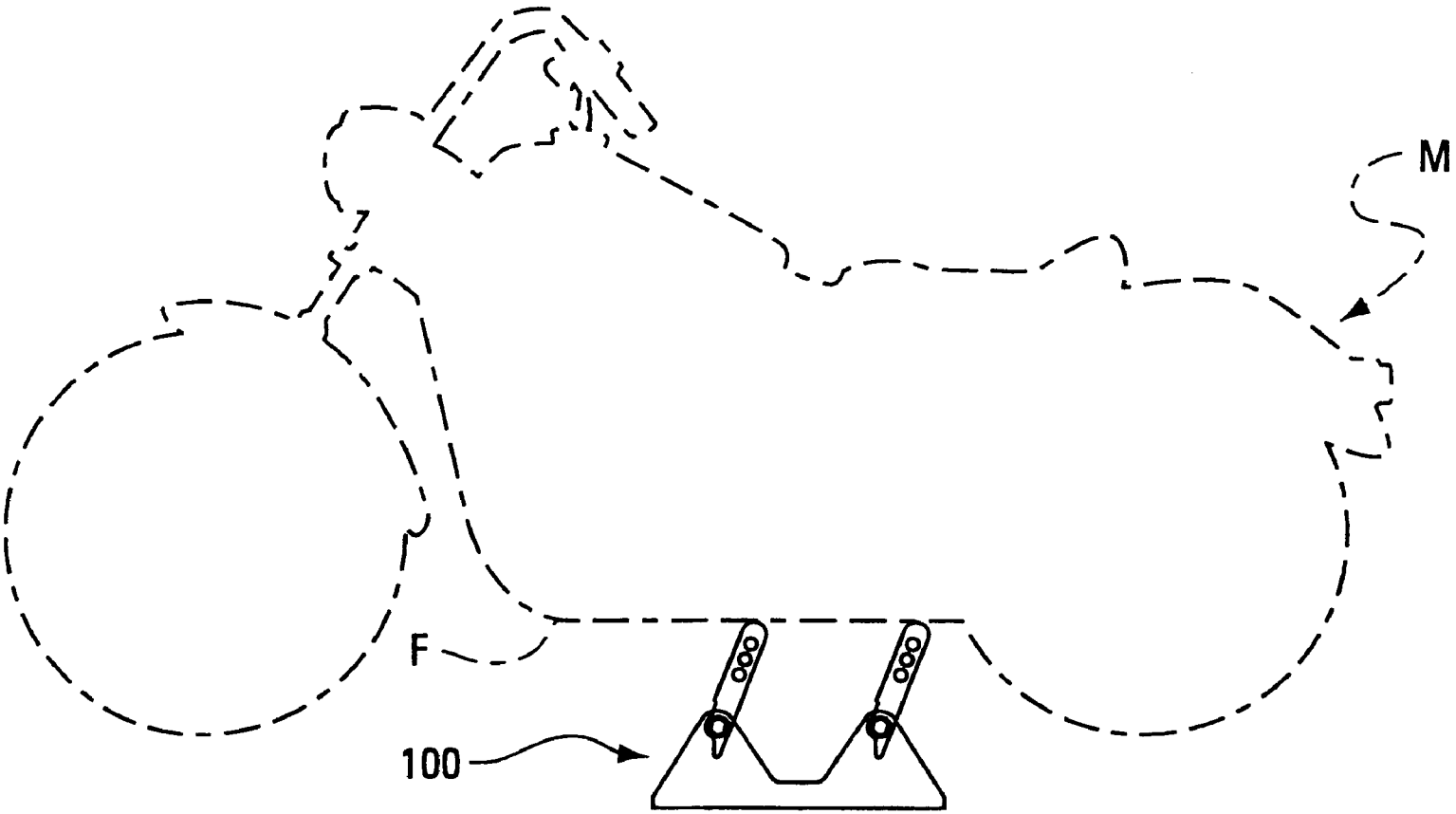
FIG. 1 is a side view showing one embodiment of the stand positioned beneath and supporting a motorcycle.
Figure 2:
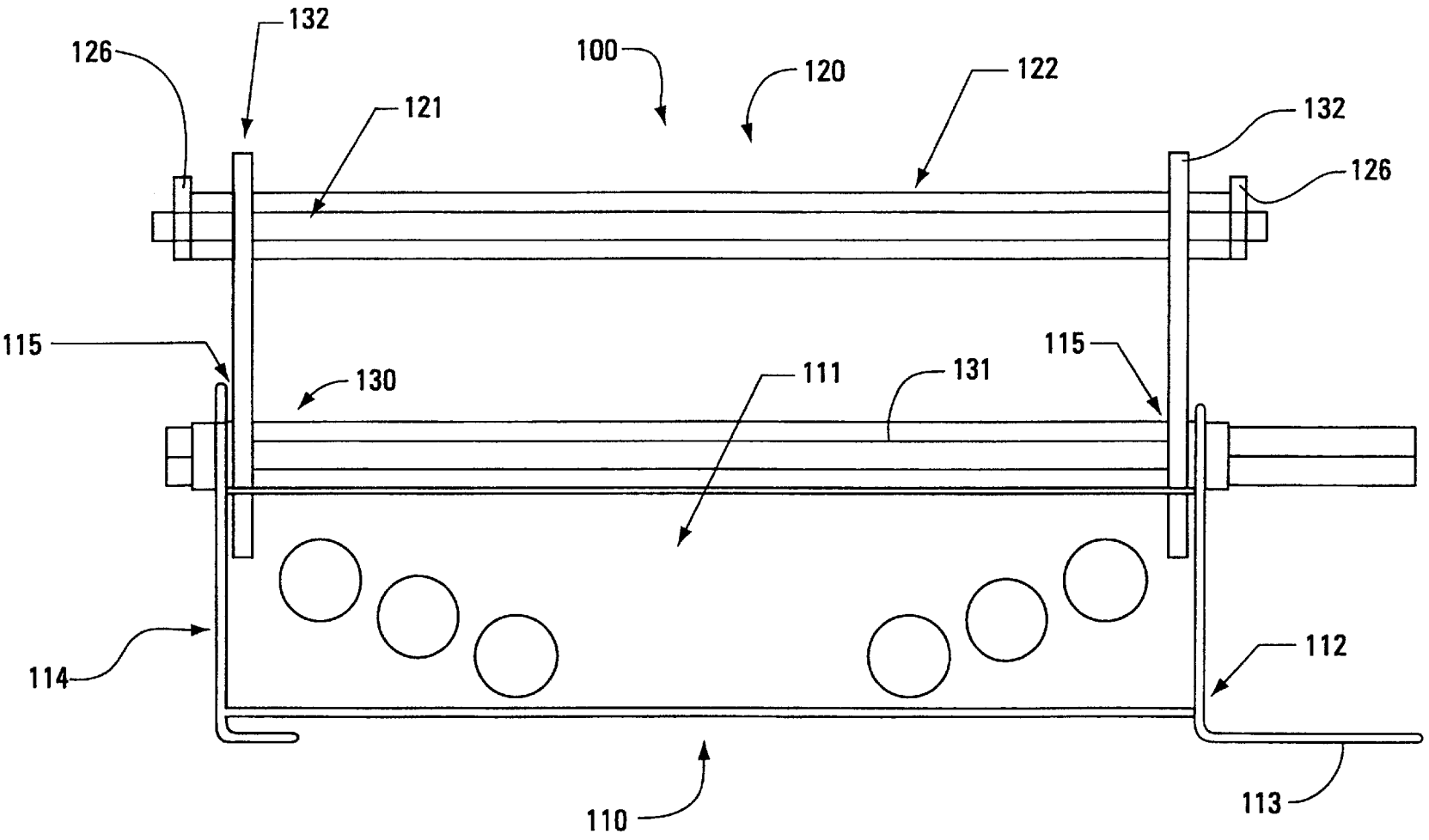
FIG. 2 is a front view of one embodiment of the stand in the support position.
Figure 3:
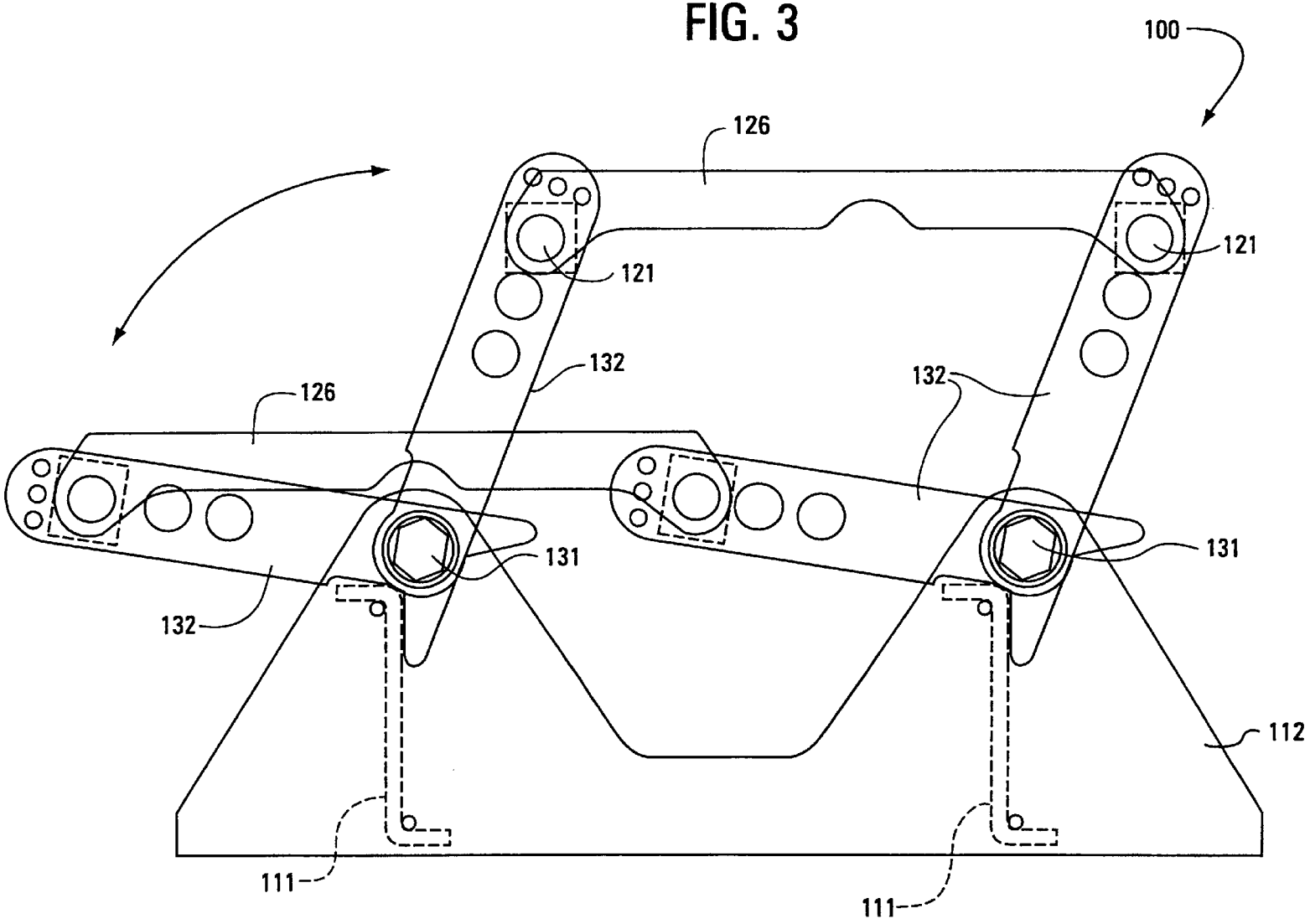
FIG. 3 is a side view of the stand shown in FIG. 2, showing pivoting of the mounting assembly and support assembly between the clearance position and the support position.

With reference to the drawings, and in particular to FIGS. 2 and 3, the motorcycle stand is generally indicated by reference number 100. The motorcycle stand 100 includes a pair of support assemblies 120 rotatably mounted to a corresponding mounting assembly 130, which in turn are pivotably mounted to a base assembly 110. As seen in FIG. 1, the stand 100 is effective for supporting the frame F of a motorcycle M upon the support assemblies 120 in an elevated position. The stand 100 may be positioned to elevate one end of the motorcycle, or positioned centrally under the frame F to elevate both ends of the motorcycle as shown in FIG. 1. Essentially identical elements with essentially similar function are denoted with identical reference numerals.

BASE ASSEMBLY

FIGS. 2 and 3 show an embodiment of the base assembly 110 comprising first 112 and second 114 saw tooth legs connected by a pair of central beams 111.

Main bearings 115 are positioned within orifices (unnumbered) proximate both apexes (unnumbered) of each saw tooth leg 112 and 114 for rotatably supporting a pair of pivot shafts 131.

An optional foot flange 113 longitudinally extends from the bottom edge (unnumbered) of the first leg 112 a distance sufficient to permit the foot flange 113 to be engaged by a user's foot (not shown) for stabilizing the stand 100 during pivoting of the support assemblies 120 between a clearance position and a support position. Generally, a foot flange 113 having a longitudinal length of about 2 to 10 cm is effective for achieving the desired stabilization effect, with a length of about 6 to 10 cm generally preferred.

Figure 10:
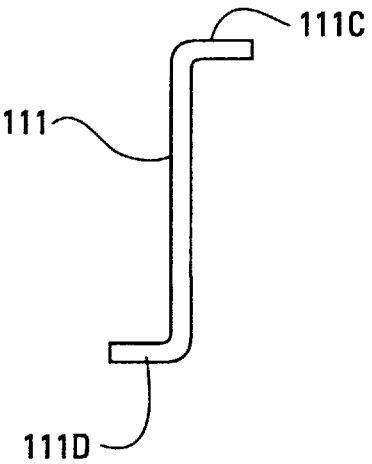
FIG. 10 is an enlarged side view of the central beam shown in FIG. 9.
Figure 12:
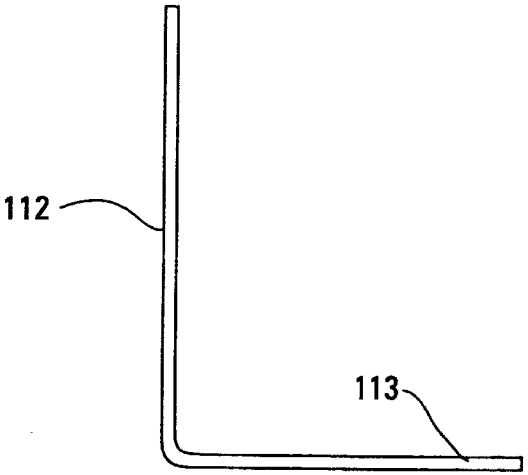
FIG. 12 is an enlarged side view of the first leg shown in FIG. 11.
Figure 11:
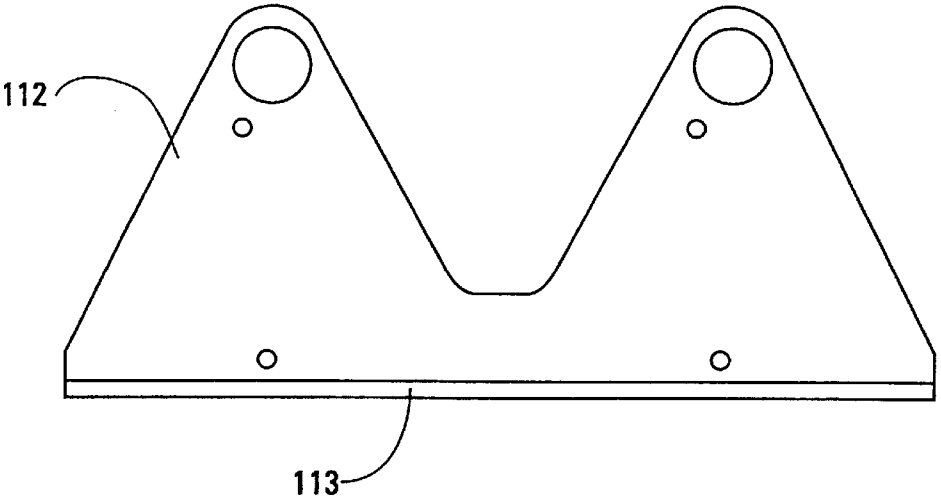
FIG. 11 is an enlarged front view of the first leg shown in FIG. 2.
Figure 14:
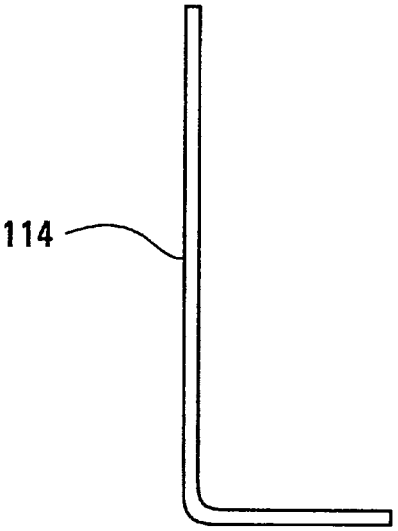
FIG. 14 is an enlarged side view of the second leg shown in FIG. 13.
Figure 13:
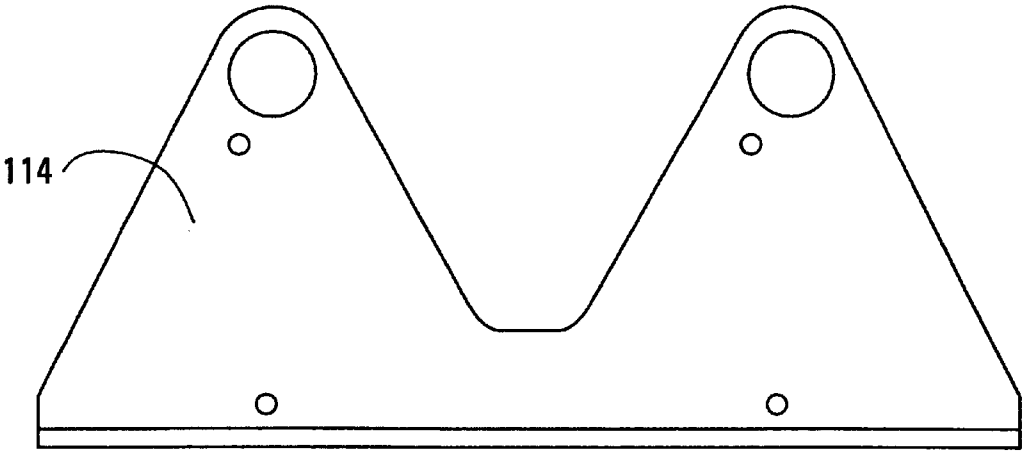
FIG. 13 is an enlarged front view of the second leg shown in FIGS. 2 and 3.

As shown best in FIGS. 3 and 10, the central beams 111 are preferably Z beams, each having a forward extending top flange 111*c* and a rearward extending bottom flange 111*d* for purposes of providing superior lateral support (i.e., structural support from front to back), and providing a surface 111*c* for stopping continued motion of the brackets 132 at the clearance position as well as supporting the brackets 132 in the clearance position.

The beams 111 and legs 112 and 114 may be constructed from a single unitary piece of material or the beams 111 may be connected to the legs 112 and 114 by any convenient means such as welding.

MOUNTING ASSEMBLY

FIGS. 2 and 3 show an embodiment of the mounting assemblies 130, with each mounting assembly 130 comprising (i) a pivot shaft 131 rotatably supported within a main bearing 115 in each of the legs 112 and 114 of the base assembly 110, and (ii) a pair of brackets 132 with one bracket of each pair proximate each longitudinal end 131*a* and 131*b* of a pivot shaft 131. The brackets 132 are fixedly attached to the corresponding pivot shaft 131 so that rotational motion of the pivot shaft 131 is translated into a pivoting motion of the corresponding brackets 132.

Pivot Shaft

Figure 5:
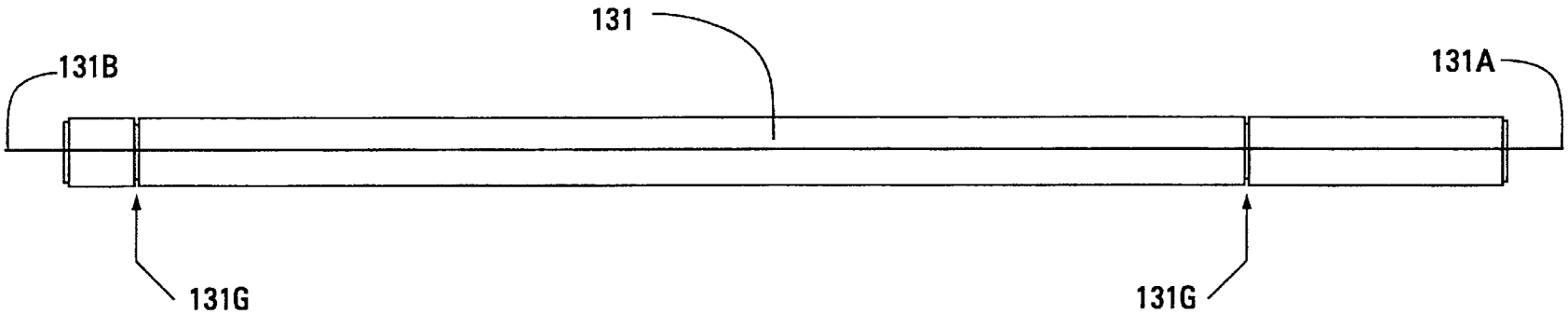
FIG. 5 is an enlarged front view of the pivot shaft shown in FIGS. 2 and 3.

As shown in FIG. 5, the pivot shafts 131 can be provided with circumferential grooves 131*g* proximate both longitudinal ends 131*a* and 131*b* for accommodating a retaining ring (not shown) so as to prevent the pivoting shafts 131 from longitudinally sliding within the main bearings 115. Other similar retention means can be also be employed, such as a cotter pin (not shown) inserted through a radically extending hole (not shown) in each end 131*a* and 131*b* of each pivot shaft 131.

The first end 131*a* of one of the pivot shafts 131 extends a substantial distance beyond the vertical portion (unnumbered) of the first leg 112 to facilitate attachment of a socket 202 to the extended distal end 131*a* of the pivot shaft 131 for rotating the pivot shaft 131 between the clearance and support positions. The first end 131*a* of the extended pivot shaft 131, and optionally the entire length of the extended pivot shaft 131, preferably has a cross-section with corners (e.g., triangular, square, pentagonal, hexagonal, etc.) which can be engaged by a matching socket 202. If desired, the extended pivot shaft 131 can be configured and arranged so that both ends 131*a* and 131*b* of the extended pivot shaft 131 project a sufficient distance beyond the corresponding leg 112 and 114 that the extended pivot shaft 131 can be accessed and rotated from either end of the stand 100. The non-extended pivot shaft 131 optionally has a cross-section with comers (e.g., triangular, square, pentagonal, hexagonal, etc.) as well.

Brackets

Figure 4:
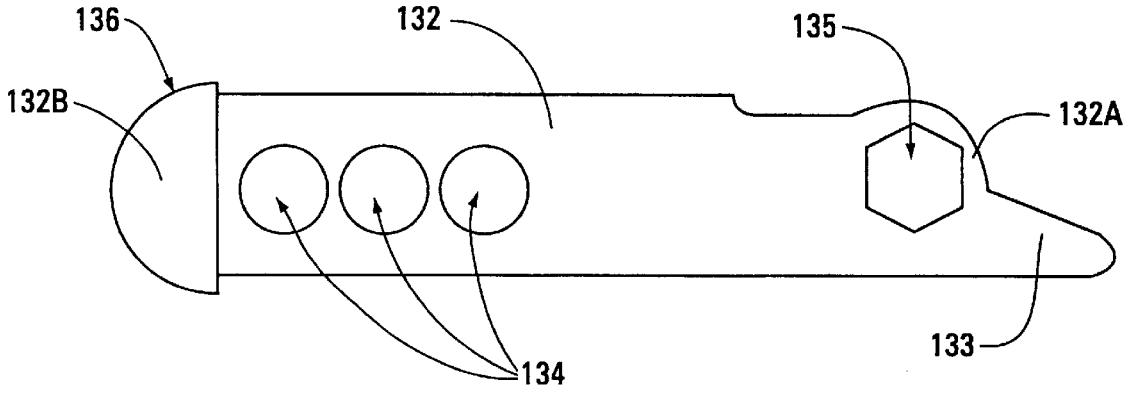
FIG. 4 is an enlarged side view of one of the brackets shown in FIGS. 2 and 3.

As shown best in FIG. 4, each of the four brackets 132 includes (i) a hole 135 proximate the proximal end 132*a* of the bracket 132 for permitting passage of a pivot shaft 131 through the bracket 132, (ii) a plurality of transversely spaced holes 134 proximate the distal end 132*b* of each bracket 132 for accommodating a support assembly bearing 125 and permitting passage of a support assembly axle 121 through the bearing 125, and (iii) an offset finger 133 extending from the proximal end 132*a* of the bracket 132 for contacting a central beam 111 so as to stop continued motion of the bracket 132 at the support position and support the brackets 132 and support assemblies 120 in the support position, including any motorcycle M resting upon the support assemblies 120.

When the pivot shafts 131 have a cross-sectional configuration with comers (e.g., triangle, square, pentagon, hexagon, etc.), holes 135 through the corresponding pair of brackets 132 are preferably shaped to match the cross-sectional shape of the pivot shaft 131 so that rotation of the pivot shaft 131 results in a pivoting of the pair of brackets 132 about the longitudinal axis (not shown) of the pivot shaft 131.

As shown best in FIG. 3, the brackets 132 are pivoted slightly past the center of gravity when in the support position. This tends to lock the brackets 132 and corresponding support assemblies 120 into position and prevent accidental pivoting of the brackets 132 and support assemblies 120 from the support position to the clearance position, particularly when the additional weight of a motorcycle M is bearing down upon the support assemblies 120. Generally, an angle of about 2° to 10° past the center of gravity is effective for locking the brackets 132 and support assemblies 120 into the support position.

As may be seen best in FIGS. 1, 2 and 3, the distal ends 132*b* of the brackets 132 extend beyond the support assembly 120 and serve as stops to ensure that the frame F of a motorcycle M remains centered on the support tubes 122. The distal ends 132*b* of the brackets 132 can be coated with an outer layer 136 of a soft material, such as a natural or synthetic rubber or polyurethane compound, to prevent the distal ends 132*b* of the brackets 132 from scratching the frame F of a motorcycle M mounted upon the stand 100.

SUPPORT ASSEMBLY

A support assembly 120 is rotatably retained in a transversely spaced relationship relative to the base assembly 110 by each pair of brackets 132.

Figure 6:
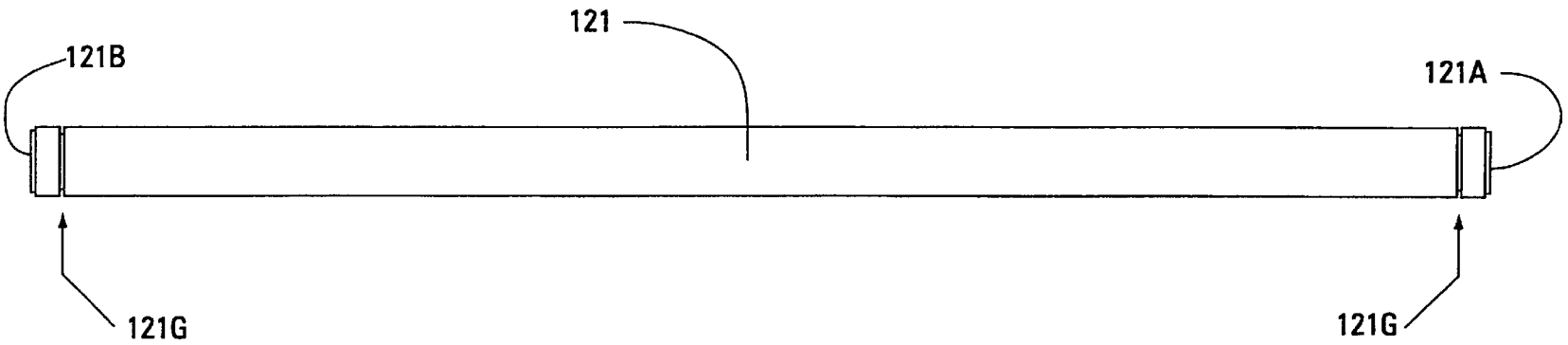
FIG. 6 is an enlarged front view of the support assembly axle shown in FIGS. 2 and 3.
Figure 7:
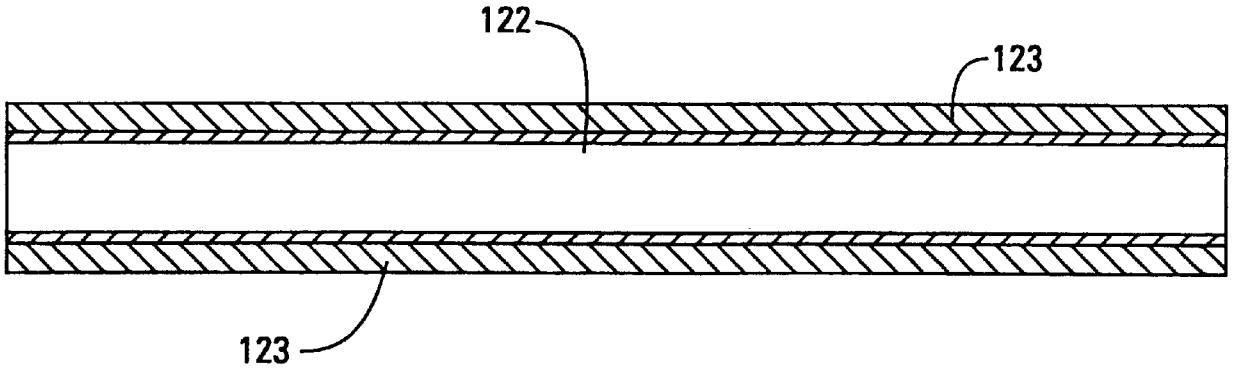
FIG. 7 is an enlarged front view of the support tube shown in FIGS. 2 and 3.
Figure 8:
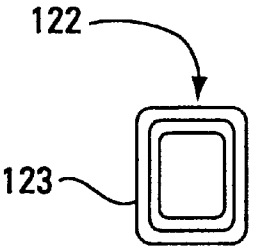
FIG. 8 is an enlarged side view of the support tube shown in FIG. 7.
Figure 9:
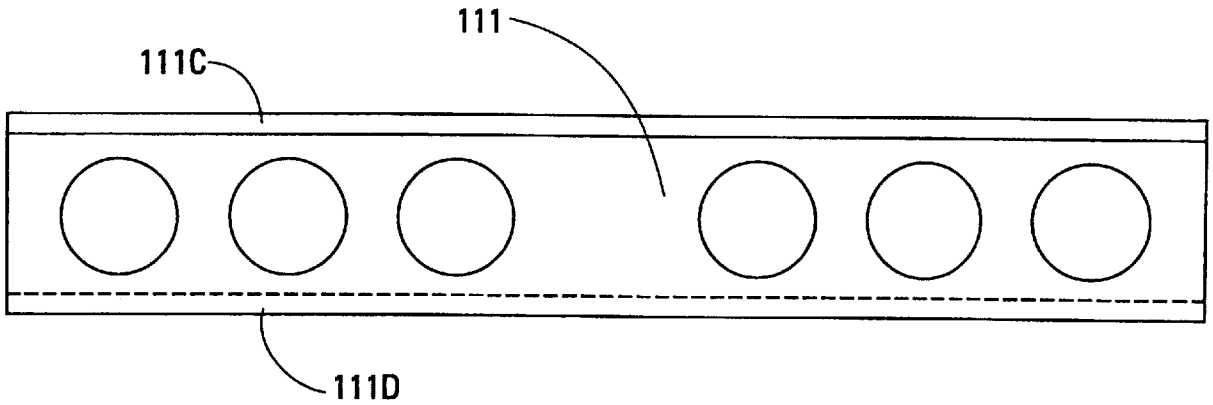
FIG. 9 is an enlarged front view of the central beam shown in FIGS. 2 and 3.

FIGS. 6 and 7 show an embodiment of the support assembly 120 comprising an axle 121 and a support tube 122, with the channel (unnumbered) through the support tube 122 sized to accommodate passage of the axle 121 with limited tolerance.

The support tube 122 can be coated with an outer layer 123 of a soft material, such as a natural or synthetic rubber or polyurethane compound, to prevent the support tube 122 from scratching the frame F of the motorcycle M.

Support assembly bearings 125 are provided at both ends 121*a* and 121*b* of each axle 121 for rotatably supporting each axle 121 within a longitudinally aligned pair of holes 134 through a pair of brackets 132.

As shown in FIG. 6, the axle 121 of each support assembly 120 can be provided with circumferential grooves 121*g* proximate both longitudinal ends 121*a* and 121*b* for accommodating a retaining ring (not shown) and thereby preventing the axle 121 from longitudinally sliding within the bearings 125. Other similar retention means can also be employed, such as a cotter pin (not shown) inserted through a radically extending hole (not shown) in each end 121*a* and 121*b* of the axle 121.

Figure 16:
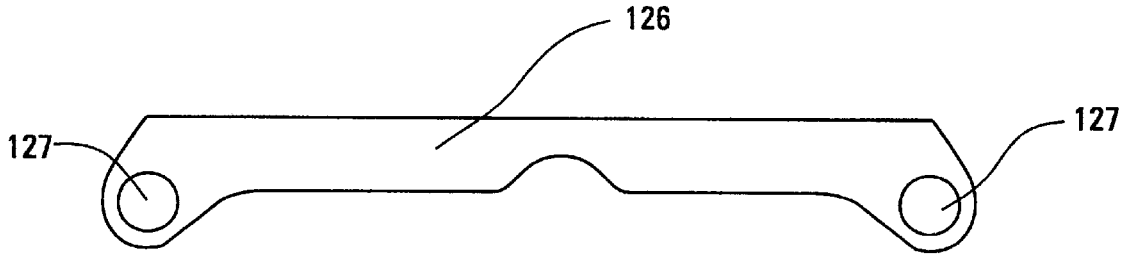
FIG. 16 is an enlarged side view of one of the connect arms shown in FIGS. 2 and 3.

As shown in FIGS. 2 and 3, a pair of connect arms 126 extend perpendicularly between the pair of support assembly axles 121 with a first connect arm 126 connecting the first longitudinal ends 121*a* of the axles 121 and a second arm 126 connecting the second longitudinal ends 121*b* of the axles 121. As shown in FIG. 16, the connect arms 126 have a hole 127 through each end (unnumbered) for permitting passage of an end 121*a* or 121*b* of a support axle 121 therethrough. The connect arms 126 are preferably connected to the axles 121 between the bracket 132 and the circumferential groove 121*g* at each longitudinal end 121*a* and 121*b* of each axle 121 The connect arms 126 are prevented from sliding off the axles 121 by retaining rings (not shown), or similar retaining means such as a cotter pin (not shown) inserted through a radially extending hole (not shown) in each end 121*a* and 121*b* of the axles 121.

The connect arms 126 interconnect both support assembly axles 121 and cause both support axles 121 and accompanying support tubes 122 to move together in unison as a single unit. Hence, rotation of the extended pivot shaft 131 effects simultaneous pivoting of both support assemblies 120 between the clearance and support positions.

TOOL

A tool 200 can be provided to facilitate rotation of the extended pivot shaft 131 and thereby effect pivoting of both and support assemblies 120 the accompanying brackets 132 between the clearance and support positions.

Figure 15:
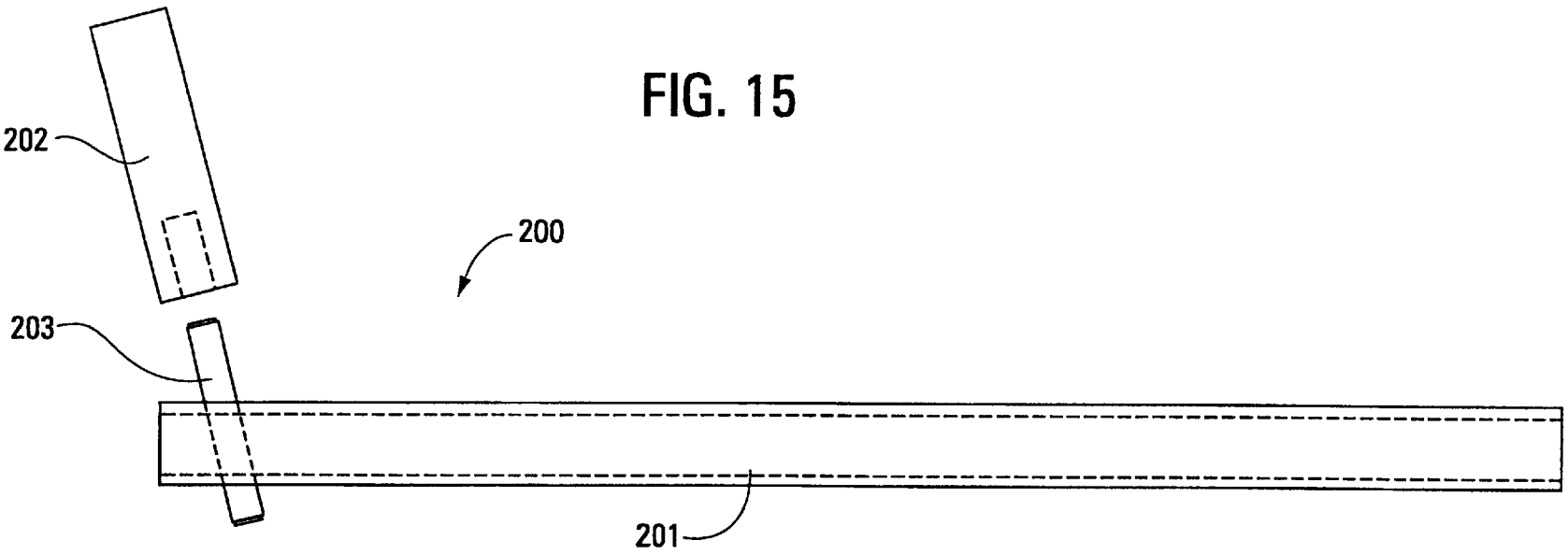
FIG. 15 is a side view of one embodiment of a tool for engaging the pivot shaft and pivoting the mounting assembly and support assembly between the clearance position and the support position.

FIG. 15 shows an embodiment of the tool 120 comprising a handle 201 with a suitably sized and shaped socket 202 removably attached to one end of the handle 201 by a dowel 203. The other end of the handle 201 can be knurled (not shown)or coated with a soft material, such as a natural or synthetic rubber or polyurethane, to enhance gripability of the tool 200.

Use

As shown best in FIGS. 1, 2 and 3, stand 100 is used by (i) placing the support assembly 120 into the clearance position, (ii) sliding the stand 100 underneath the frame F of the motorcycle M at the desired location, (iii) attaching the socket 202 to the handle 201, (iv) engaging the first end 131*a* of the extended pivot shaft 131 with the socket 202, (v) stepping onto the foot flange 113 to stabilize the stand 100, and (vi) rotating the pivot shaft 131 so as to effect pivoting of both support assemblies 120 from the clearance position, generally horizontal to the ground, to the support position, generally vertical to the ground and slightly past the center of gravity. Once the support assemblies 120 begin to pivot beyond the center of gravity, the weight of the motorcycle M upon the support assembly 120 causes the support assemblies 120 to drop and lock in the support position, with the fmgers 133 of the brackets 132 bearing upon the corresponding central beam 111 of the base assembly 110. The socket 202 can then be detached from the extended pivot shaft 131 and stored until the stand 100 needs to be removed.

The stand 100 can be quickly and easily removed from underneath the motorcycle M by simply (i) attaching the socket 202 to the handle 201, (ii) engaging the first end 131*a* of the extended pivot shaft 131 with the socket 202, (v) stepping onto the foot flange 113 to stabilize the stand 100, and (iii) rotating the pivot shaft 131 so as to effect pivoting of the support assemblies 120 from the support position to the clearance position. Once the support assemblies 120 begin to pivot beyond the center of gravity, the weight of the motorcycle M upon the support assemblies 120 will force the support assemblies 120 to move towards the clearance position until the elevated motorcycle M a contacts the ground. Gravity will cause the support assemblies 120 and the corresponding brackets 132 to continue pivoting toward the clearance position until the front edge (unnumbered) of the brackets 132 bear against the top (unnumbered) of the corresponding central beam 111 of the base assembly 110. Once the support assembly 120 is in the clearance position, the socket 202 can be detached from the extended pivot shaft 131 and the stand 100 slid from underneath the motorcycle M. The stand 100 and tool 200 can then be stored together until needed.

When in the support position, the support assembly 120 engages the frame F of the motorcycle M and lifts or elevates at least one end of the motorcycle M off the ground.

Several models of the stand 100 can be constructed to provide different heights to which the stand 100 lifts the motorcycle M by varying the size of the base assembly 110. Alternatively, each stand 100 can be provided with a means for adjusting the height to which the stand 100 can lift the motorcycle M, such as by employing a plurality of spaced holes 134 through the brackets 132 as shown in FIGS. 3 and 4. When such a means for adjusting the height of the support assembly 120 is employed, the height may be quickly adjusted by (i) removing the retaining rings (not shown) from the circumferential groove 121*g* in the first end 121*a* of each axle 121, (ii) sliding each axle 121 completely through both connect arms 126 and both brackets 132, (iii) reinserting each axle 121 through both connect arms 126 and both brackets 132 using a different set of longitudinally aligned holes 134 through the brackets 132, and (iv) replacing the retaining rings on each axle 121. The procedure can also be done from the other longitudinal end of the stand 100 by removing the retaining rings (not shown) from the circumferential groove 121*g* in the second end 121*b* of each axle 121.

While preferred embodiments of the invention have been described, it should be understood that various changes, adaptations and modifications may be made to the invention without departing from the spirit of the invention and the scope of the appended claims.

I claim:

1. A hand-operable stand, comprising:

(a) a base having a first longitudinal end and a second longitudinal end, (b) a support assembly pivotably attached to the base for pivoting about one or more longitudinal axes between a clearance position and a support position, with the support assembly including a pair of spaced support arms capable of being simultaneously pivoted between the clearance position and the support position, (c) a means for preventing continued pivoting of the support assembly beyond the support position, and (d) a flange longitudinally extending from the first longitudinal end of the base configured and arranged to be engaged by a user's foot for purposes of stabilizing the stand during pivoting of the support assembly between the clearance and support positions.

2. The stand of claim 1 wherein the means for effecting simultaneous pivoting of both support arms between the clearance position and the support position comprises a pair of rigid connect arms with a first end of each connect arm rotatably attached to one of the support arms and a second end of each connect arm rotatably attached to the other support arm.

3. The stand of claim 1 wherein the support assembly pivots beyond the center of gravity when pivoted from the clearance position to the support position.

4. A hand-operable stand, comprising:

(a) a base having (i) a pair of transversely spaced longitudinally extending beams, (ii) a first leg secured to the beams proximate a first longitudinal end of each beam, and (iii) a second leg secured to the beams proximate a second longitudinal end of each beam, (b) a support assembly pivotably attached to the base for pivoting about one or more longitudinal axes between a clearance position and a support position, with the support assembly including a pair of spaced support arms capable of being simultaneously pivoted between the clearance position and the support position, (c) a means for preventing continued pivoting of the support assembly beyond the support position, and (d) a mounting assembly pivotably attached to the base and holding the support assembly in a transversely spaced relationship relative to the base, wherein the support assembly and mounting assembly are pivotable together between the clearance position and the support position; the mounting assembly including (i) a pair of transversely spaced longitudinally extending pivot shafts rotatably attached to the base, and (ii) a pair of longitudinally spaced brackets fixedly attached to each pivot shaft, with (A) a first end of each bracket in each bracket pair fixedly attached to one of the pivot shafts so as to be effective for translating rotation of the pivot shafts to pivoting of the bracket pair, and (B) a second end of each bracket in each bracket pair attached to one of the support arms, (e) wherein a combination of at least one of the brackets and an associated beam are configured and arranged such that the first end of the configured and arranged bracket bears against the associated beam when the support assembly reaches the support position so as to prevent continued pivoting of the support assembly beyond the support position.

5. The stand of claim 4 wherein the first and second legs have a saw tooth configuration defining two transversely spaced apexes on each leg and each pivot shaft is rotatably attached to each leg proximate one of the apexes.

6. The stand of claim 4 wherein each bracket pair is associated with one of the beams and both brackets in both bracket pairs are configured and arranged so that the first end of the brackets bear against the associated beam when the support assembly reaches the support position.

7. The stand of claim 4 wherein the support assembly pivots about 2° to 10° beyond the center of gravity when pivoted from the clearance position to the support position.

8. The stand of claim 4 further comprising means for adjusting the transverse position of the support assembly relative to the base so as to increase or decrease the distance between the support assembly and the base.

9. The stand of claim 4 wherein the means for effecting simultaneous pivoting of both support arms between the clearance position and the support position comprises a pair of rigid connect arms with a first end of each connect arm rotatably attached to one of the support arms and a second end of each connect arm rotatably attached to the other support arm.

10. A hand-operable stand, comprising:

(a) a base having longitudinally spaced first and second legs, (b) a support assembly pivotably attached to the base for pivoting about one or more longitudinal axes between a clearance position and a support position, with the support assembly including a pair of spaced support arms capable of being simultaneously pivoted between the clearance position and the support position, (c) a means for preventing continued pivoting of the support assembly beyond the support position, and (d) a mounting assembly pivotably attached to the base and holding the support assembly in a transversely spaced relationship relative to the base, wherein the support assembly and mounting assembly are pivotable together between the clearance position and the support position; the mounting assembly including (i) a pair of transversely spaced longitudinally extending pivot shafts rotatably attached to the base, with at least one of the pivot shafts having a first end with a hexagonal cross-section longitudinally extending beyond one of the legs of the base a distance sufficient to accommodate attachment of a socket, and (ii) a pair of longitudinally spaced brackets fixedly attached to each pivot shaft, with (A) a first end of each bracket in each bracket pair fixedly attached to one of the pivot shafts so as to be effective for translating rotation of the pivot shafts to pivoting of the bracket pair, and (B) a second end of each bracket in each bracket pair attached to one of the support arms.

11. The stand of claim 10 wherein the means for effecting simultaneous pivoting of both support arms between the clearance position and the support position comprises a pair of rigid connect arms with a first end of each connect arm rotatably attached to one of the support arms and a second end of each connect arm rotatably attached to the other support arm.

12. The stand of claim 10 further comprising means for adjusting the transverse position of the support assembly relative to the base so as to increase or decrease the distance between the support assembly and the base.

* * * * *